US006022017A

United States Patent [19]

Cummings et al.

[11] Patent Number: 6,022,017

[45] Date of Patent: Feb. 8, 2000

[54] METHOD FOR HANDLING A SMALL GAP ORDER CHANGE IN A CORRUGATOR

[75] Inventors: James A. Cummings; Erik D. Langfoss, both of Phillips, Wis.

[73] Assignee: Marquip, Inc., Phillips, Wis.

[21] Appl. No.: 09/089,125

[22] Filed: Jun. 2, 1998

[51] Int. Cl.[7] ..... B65H 29/32

[52] U.S. Cl. ..... 271/197; 271/202; 271/203; 271/216

[58] Field of Search ..... 271/202, 203, 271/196, 197, 182, 183, 189, 190, 216

[56] References Cited

U.S. PATENT DOCUMENTS

| | | | |
|---|---|---|---|
| 4,133,523 | 1/1979 | Berthelot | 271/202 |
| 4,184,392 | 1/1980 | Wood | 271/203 |
| 4,200,276 | 4/1980 | Marschke . | |
| 4,313,600 | 2/1982 | Mosburger | 271/203 |
| 4,598,901 | 7/1986 | Thomas . | |
| 4,667,953 | 5/1987 | Hirakawa et al. | 271/202 |
| 4,805,890 | 2/1989 | Martin | 271/203 |
| 5,054,763 | 10/1991 | Achelpehl et al. | 271/202 |
| 5,496,431 | 3/1996 | Hirakawa et al. . | |

FOREIGN PATENT DOCUMENTS

| | | | |
|---|---|---|---|
| 956658 | 10/1974 | Canada | 271/183 |
| 44 25 155 | 1/1996 | Germany . | |
| 2037714A | 7/1980 | United Kingdom | 271/202 |
| 2059392A | 4/1981 | United Kingdom | 271/202 |

*Primary Examiner*—H. Grant Skaggs

*Attorney, Agent, or Firm*—Andrus, Sceales, Starke & Sawall

[57] ABSTRACT

Certain parameters in a high speed order change in a corrugator, including a small gap between orders and the relative lengths of the old and new order sheets, require altered order change and discharge routines on the downstacker conveyor system in order to prevent edge butt between the last sheet of the old order and the first sheet of the new order. Alternate order change and order discharge routines, which are automatically implemented by the downstacker system controller, include accelerated movement of the old order shingle out of the downstacker vacuum conveyor to outrun the incoming first sheet of the new order or, alternately, allowing the first sheet of the new order to overrun the tail end of the old order and utilizing, if necessary, a device to divert the lead edge of the first new order sheet upwardly to allow the shingle to be reestablished.

7 Claims, 4 Drawing Sheets

METHOD FOR HANDLING A SMALL GAP ORDER CHANGE IN A CORRUGATOR

BACKGROUND OF THE INVENTION

The present invention pertains to a system for effecting an order change in the stacking system of a corrugator and, more particularly, to a method for effectively handling small gap order changes.

In a corrugator dry end, a corrugated paperboard web is longitudinally scored and slit into multiple parallel output webs (or "outs"), and the outs are directed through one or more downstream cut-off knives which cut the output webs into selected sheet lengths. The sheets are then directed into a variable speed stacking system where the sheets are compressed into a shingle and delivered into a downstacker where a vertical stack of sheets is formed for discharge. Order changes must be effected while the upstream corrugator wet end continues to produce and deliver the continuous web to the dry end. An order change will typically require repositioning of the slitter-scorer and a change in the sheet length provided by the cut-off knife or knives.

In order to accommodate repositioning of the slitting and scoring tools for an order change, two basic types of order change systems have been developed in the corrugated industry. One of the order change systems is known as a gap style system. A gap system uses a rotary shear positioned immediately downstream of the corrugator wet end. At order change, the rotary shear is operated to make a cross cut through the entire web. The downstream dry end equipment is accelerated to pull a gap between the tail edge of the old running order and the leading edge of the new order defined by the shear cut. As the tail edge of the web passes through the slitter-scorer, the slitting and scoring tools are repositioned in the gap and set for the new order.

The other system is known as a gapless or plunge style order change system. In this system, there are two sets of slitting and scoring tools immediately adjacent one another in the direction of web movement and through both of which the corrugated web travels. At order change, one slitter-scorer, operating on the currently running order, will lift out of operative engagement with the web, and the other slitter-scorer which is set to the new order alignment plunges down into operative engagement with the web. The result is a small order change region of corrugated web with overlapping slits and scores for both the old order and the new order.

In U.S. Pat. No. 5,496,431, a laterally adjustable cutting tool is positioned over the center of the web and makes a running diagonal cut to provide a transition in the widths of the outs between the old and new orders. In this region, the slitter-scorer for the old order is withdrawn and the slitter-scorer for the new order is plunged into the web. The diagonal pieces which are formed to provide the gapless order change cannot be discharged in the usual manner onto the downstream stacks of corrugated board. Thus, the board pieces exiting the downstream cut-off knife containing the diagonal connecting slit and the overlapping slit and score lines require the use of a separate diverter downstream of each cut-off knife to divert the resultant scrap sheets.

In German Patent 44 25 155, alternately operable plunge cut slitter-scorers are utilized, but the overlapping slits and scores from the old and new orders are removed by positioning a separate rotary shear and scrap sheet diverter between the slitter-scorer and the cut-off knife.

In all of the foregoing order change systems, a gap is eventually created between the corrugated board forming the old and new orders. The gap may be formed upstream of the slitter-scorer, between the slitter-scorer and the cut-off knife, or after the cut-off knife. As a result of the various order change systems and depending also on corrugator line speed, the gap may be larger than 2 seconds in time or as short as 0.2 second. In the stacking system, immediately downstream of the cut-off knife, the sheets are shingled in a process which necessarily requires the sheets to be slowed to create the overlap in the shingle. In a manner known in the art, the stacking system typically includes a series of variable speed conveyors, including an upstream shingling conveyor receiving sheets directly from the cut-off knife. At order change, the old order shingle is separated from the sheets of the new order by accelerating the stacker conveyors, directing the old order sheets into the stacker, and sequentially slowing the stacker conveyors in the downstream direction with passage of the tail end of the old order, in a manner described in U.S. Pat. No. 4,200,276.

At order change, where the gap between the tail edge of the last sheet of the old order and the lead edge of the first sheets of the new order is large (e.g. 2 seconds), the shingled old order is able to clear the vacuum shingling conveyor before the first sheet of the new order (being fed at higher line speed) overtakes the old order. Increasing corrugator and line speeds, up to and above 1,000 feet per minute (300 m/min), have led to a number of modifications in stacker systems. The delivery of relatively short sheets at high speeds led to the development of two stage shingling by positioning two adjacent vacuum shinglers at the upstream end of the stacking conveyor system. Sheets are thus preshingled at a somewhat higher speed (e.g. 50% of line speed) and immediately reshingled at a lower speed (e.g. 25% of line speed) for discharge into the downstacker.

If an old order is followed by a new order of substantially longer length sheets (e.g. 200 inches or about 5 m), a relatively small gap between the orders may result in the lead edge of the long first sheet of the new order overtaking the tail edge of the last sheet of the old order while the latter is still in the shingling section of the stacker system. The result is socalled "edge butt" where the higher speed overrunning new order sheet hits the last sheet of the old order causing it to be knocked out of position on the shingle with consequent misfeed and jamming.

One prior art method for preventing edge butt involves stopping the entire stacker conveyor system immediately upon the tail edge of the last sheet of the old order being captured by the upstream end of the first vacuum conveyor. Because the tail end of the first vacuum shingling conveyor is positioned vertically below the line speed input nip (e.g. 1.5 inches or about 40 mm), the first sheet of the new order will override the tail edge of the last sheet of the old order, the shingle will be reestablished, whereupon the stacker system conveyors are restarted and the old and new orders separated as the tail edge of the former moves past the downstream end of the second vacuum shingling conveyor.

It has now been discovered that, where the old order sheets are relatively short, such as about 24 inches (about 0.6 m), the new order sheets are significantly longer, such as about 60 to about 200 inches (about 1.5 to 5 m), and the gap between orders is small, such as about 0.5 second or less, reestablishing the shingle and allowing the first new order sheet to override the old order causes another problem. The long new order sheet, because it overruns a number of sheets at the tail end of the old order shingle, imposes a normal force on the tail end of the shingle such that, at the downstream separation point, the tail end of the old order shingle cannot be satisfactorily pulled from beneath the long overriding sheet. As a result, a number of short old order sheets are typically left behind, disrupting the sheet count and the discharge process.

SUMMARY OF THE INVENTION

In accordance with the present invention, a method is provided for preventing edge butt at order change by utilizing alternate control strategies, one of which includes modification of the stacker system hardware. Each of the alternate routines for preventing edge butt includes adjustment of the speeds of the stacker system conveyors, including the vacuum shingling conveyors, and may be implemented automatically by the stacker control system based on continuously monitored parameters. Thus, the ongoing monitoring of line speed, the variable speeds of the various stacker system conveyors, the gap between orders, and the lengths of the old and new order sheets are utilized to automatically implement the optimum routine for preventing edge butt. The method of the present invention is preferably implemented in a stacker of the type in which sheets are individually fed at the fixed line speed onto a first shingling conveyor which is operating below line speed to form a shingle of sheets. The shingle is thereafter conveyed over a plurality of downstream conveyors at a discharge speed to a stacking device where the shingle is formed into a vertical stack of sheets.

In accordance with the method of the present invention, a determination if edge butt will occur is made by utilizing a measurement of the gap between the old and new orders, the difference between the line speed and the shingling conveyor speed, and the length of the new order sheets. If the calculation determines that edge butt will occur, one of a number of routines is selected to adjust the speeds of the shingling conveyor and downstream stacking system conveyors to either shingle the first sheet of the new order on the old order, or accelerate the shingling and downstream conveyors simultaneously to a speed above shingling speed and approaching line speed which is sufficient to prevent the gap from closing before the tail edge of the first sheet of the new order is captured by the vacuum shingling conveyor. Thereafter, these stacking system conveyors are returned to normal discharge speed. Preferably, the stacking system is of the type which receives sheets from a driven nip positioned immediately upstream of the shingling conveyor which, in turn, comprises a variable speed vacuum conveyor with its upstream end positioned directly below the horizontal feed line of the nip. One of the alternate routines for preventing edge butt includes the steps of stopping the shingling and downstream conveyors when the tail edge of the last sheet of the old order reaches the upstream end of the shingling conveyor, continuing to feed the first sheet of the new order until the lead edge thereof overrides the tail edge of said last sheet, and the restarting the shingling and downstream conveyors.

Preferably, the method of the present invention is implemented in a stacking system in which the first of the conveyors downstream of the first shingling conveyor comprises a second vacuum shingling conveyor, and wherein the shingling step further comprises: stopping the downstream conveyors when the tail edge of the last sheet of the old order reaches the upstream end of the second shingling conveyor; deflecting the lead edge of the first sheet of the new order vertically upward at the downstream end of the first shingling conveyor; continuing to feed the first sheet of the new order until the lead edge thereof overrides the tail edge of said last sheet; and restarting the downstream conveyors. The deflecting step preferably comprises placing a pivotable pan in a gap between the first shingling conveyor and the second shingling conveyor, pivoting the pan upwardly from a normal running position, when the downstream conveyors are stopped, to place a downstream pan edge in the path of the lead edge of the first sheet of the new order to deflect the same upwardly; and pivoting the pan to the running position when the downstream conveyors are restarted. The restarting step further comprises returning the shingling and downstream conveyors to a speed above normal discharge speed. Preferably, the restarting step comprises subsequently slowing the conveyors to discharge speed when the tail edge of the first sheet of the new order reaches the upstream end of the first shingling conveyor.

In accordance with either of the alternate routines for preventing edge butt, the conveyors are preferably returned to discharge speed when the tail edge of the first sheet of the new order reaches the upstream end and is captured by the first shingling conveyor.

BRIEF DESCRIPTION OF THE DRAWINGS

The drawing figures all compromise schematic side elevation views of a stacking system wherein.

DETAILED DESCRIPTION OF THE PREFERRED EMBODIMENT

Figure 1:
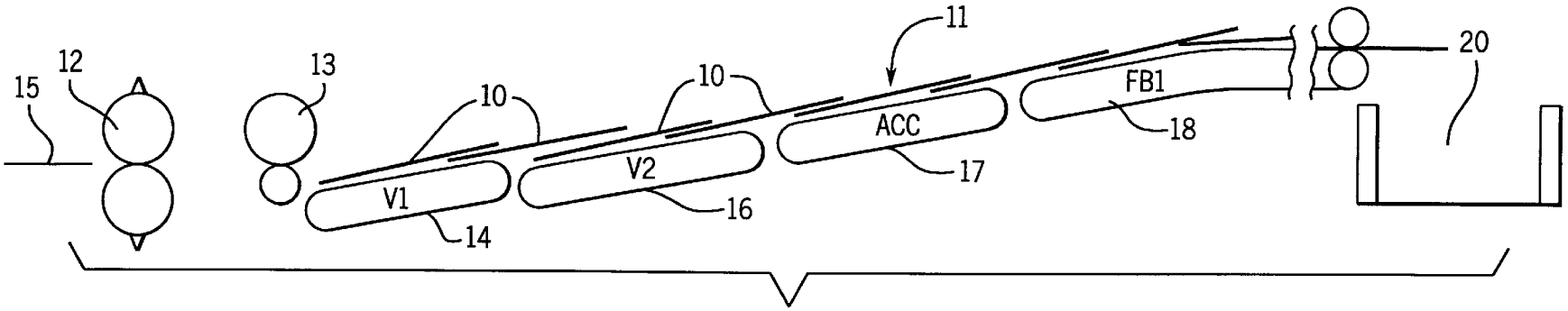
FIG. 1 shows a normally running old order.

The schematic side elevation view of FIG. 1 shows the processing of an order of sheets 10 in a conventional downstacker system 11. The sheets are cut from a running upstream web traveling through a cut-off knife 12 from which the exiting sheets 10 are accelerated slightly by passage through a knife nip roll 13 (or other knife outfeed device) to provide a small gap between sheets of order being run. A first vacuum shingling conveyor 14 is located immediately downstream from the nip roll 13 where the sheets 10 are initially shingled. The handling of short length sheets at high speeds has led to the development of two stage shingling in a downstacker. Thus, if the web 15 is being delivered at a line speed of up to 1,000 feet per minute (about 300 m/min), the first shingling conveyor 14 may be operated at about 500 fpm and provide a 50% shingle of the sheets 10. The initially shingled sheets are delivered onto a second vacuum shingling conveyor 15 operating at a stacker discharge speed of 250 fpm where the sheets are reshingled. The reshingled sheets 10 move onto a downstream accumulating conveyor 17 and continue onto one or more flat belt conveyors 18. At the downstream end of the flat belt conveyor or conveyors 18, the sheets are delivered to a downstacker 20 which automatically lowers as a stack of sheets in built up until the desired number are stacked.

As is well known in the art, separation of sheets on the downstacker system 11, so that a stack may be formed in and discharged from the downstacker 20, utilizes downstacker control of the speeds of the various conveyors 14, and 16–18. A similar strategy is used to handle an order change where the length and/or the width of the sheets 10 may be changed. Regardless of how the end of the old order and the beginning of the new order are separated, there will typically be a gap between the tail end 21 of the last sheet 22 of the old order and the lead edge 23 of the first sheet 24 of the following new order. The gap may typically range in time anywhere from over 2 seconds to about 0.2 second. If the time gap between orders is large, e.g. 2 seconds, the old order is separated from the incoming new order as the last sheet 22 leaves the second vacuum shingling conveyor 16. Thus, the typical separation point between orders is between the second shingling conveyor 16 and the accumulating conveyor 17. When the last sheet of the old order passes the separation point, the accumulating conveyor 17 and the flat belt conveyor or conveyors 18 are accelerated to pull the old order away from the lead sheets of the new order. As the first sheet 24 and following sheets of the new order enter the downstacker system 11, the vacuum shingling conveyors 14 and 16 may also be temporarily slowed (e.g. below their respective speeds of between 20% and 30% of line speed) to further lengthen the gap between the last sheet 22 of the old order and the first sheet 24 of the new order.

Figure 2:
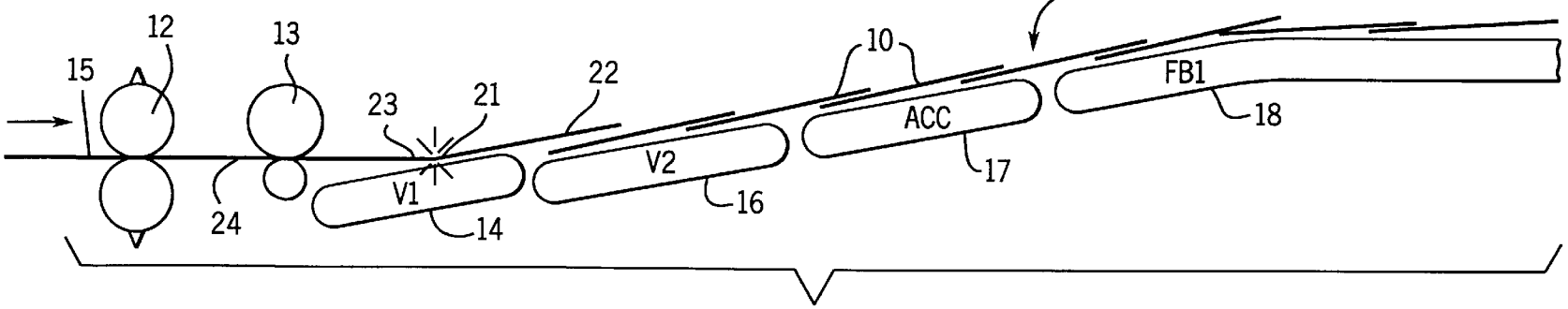
FIG. 2 shows the first sheet of an overrunning new order resulting in edge butt.

Referring also to FIG. 2, if the gap between orders is small (e.g. less than 0.5 second) and the length of the new order sheets 24 is long, the lead edge 23 of the first new order sheet 24, running with a line speed that is above discharge speed, may overtake the last sheet 22 of the old order on the first vacuum shingling conveyor 14 which is operating at only 50% of line speed. Depending on the length of the gap, the lead edge 23 of the new order first sheet may not overtake the tail end of the old order last sheet 22 until the latter is on the second vacuum shingling conveyor 16 which is operating at 50% of line speed. Collision could also occur on the accumulator conveyor 17, or flat belt section 18 depending on the size of the gap. In either event, however, the result is a collision between the sheets 24 and 22, commonly referred to in the industry as edge butt or board butt. If edge butt is not prevented, the collision will drive the last sheet 22 of the old order in a downstream direction and disrupt the shingle.

One routine which has been developed to prevent edge butt is to reestablish a shingle between the old and new orders right at the upstream end of the downstacker system, namely, on the first vacuum shingling conveyor 14. This is accomplished by stopping all of the downstacker conveyors 14, 16, 17 and 18 as soon as the tail of the last sheet 22 of the old order is captured by the first vacuum conveyor 14. As may be seen in the drawings, the upstream end 25 of the first vacuum conveyor 14 is positioned vertically below the infeed nip 13 so that as the sheet leaves the nip, the tail end 21 drops down onto the conveyor, drawn by the vacuum force. However, with the conveyors stopped, the lead edge 23 of the first sheet 24 of the new order will close the gap and, as it passes through the nip roll 13, will override the last sheet 22 of the old order and reestablish the shingle. At that point, the downstacker conveyors are restarted for discharge in a normal manner with order separation taking place between the second vacuum shingling conveyor 16 and the accumulating conveyor 17, as previously described. The problem with the foregoing routine is that, when an old order of relatively short length sheets is followed by a new order of substantially longer sheets, the first sheet of the new order (which remains under the control of the nip roll 13 running at line speed for the full length of the sheet) will completely overrun a number of short sheets of the old order. When the old order is attempted to be separated at the downstream separation point, the weight of the long new order sheet may prevent some of the last short sheets of the old order from being pulled out from under the long sheet. This, of course, may result in disruption of the old order, as the new order is long and stable.

Figure 3:
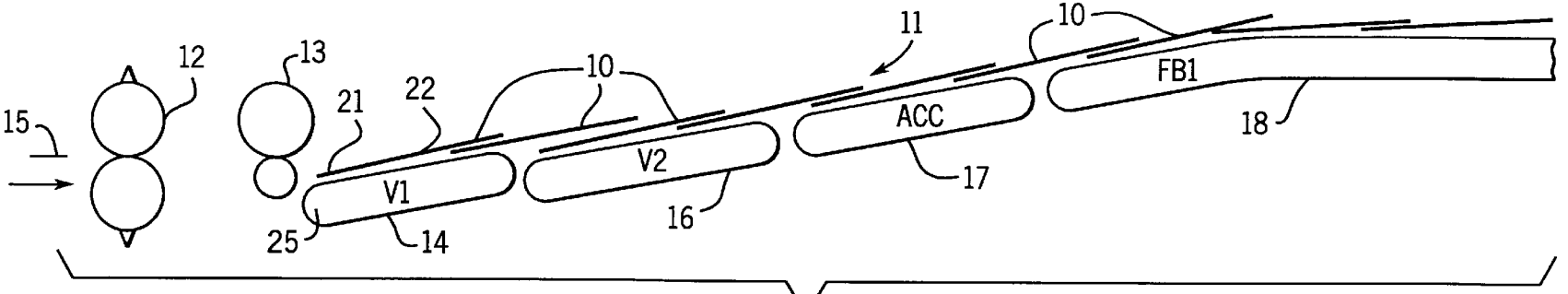
FIGS. 3–5 show sequenced views of one method of the present invention for preventing edge butt.
Figure 4:
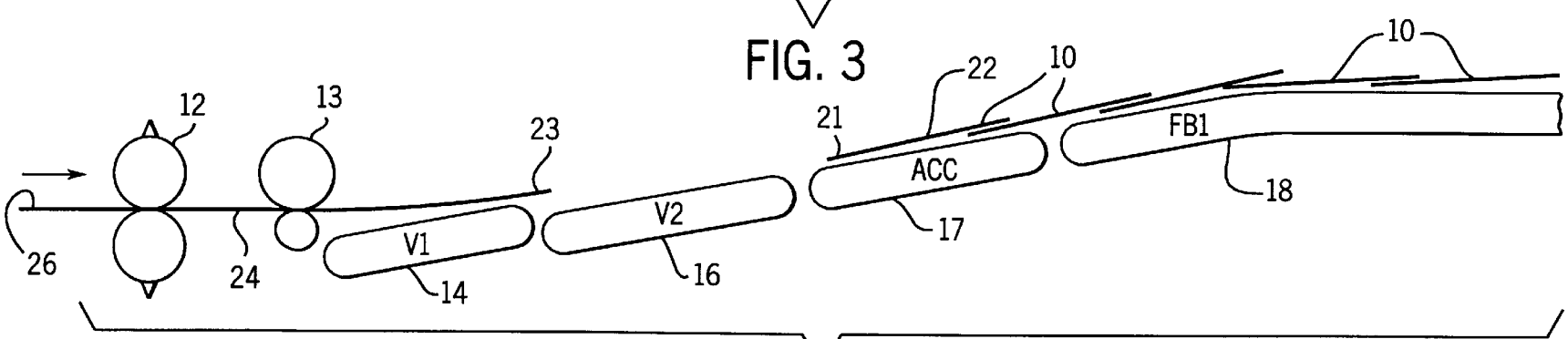
Figure 5:
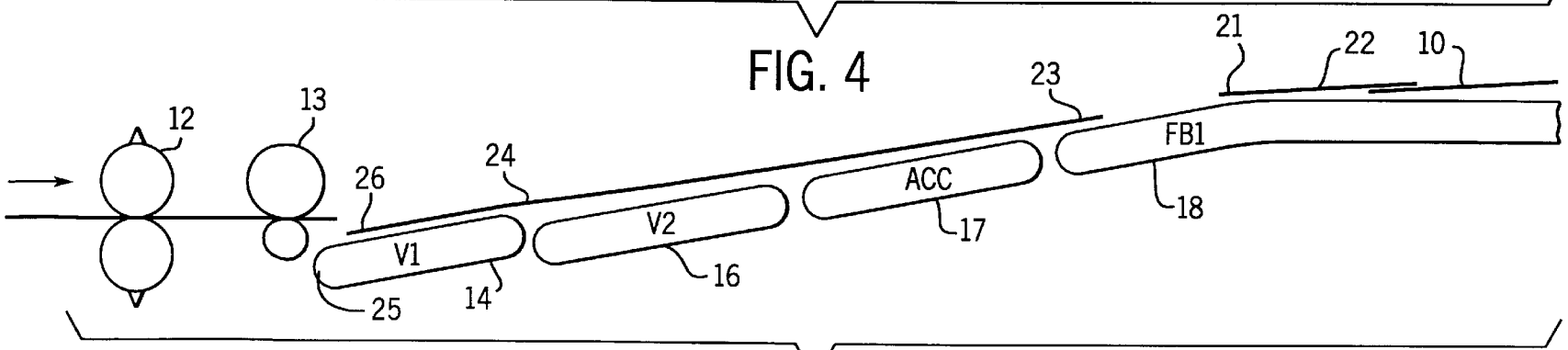
Figure 6:
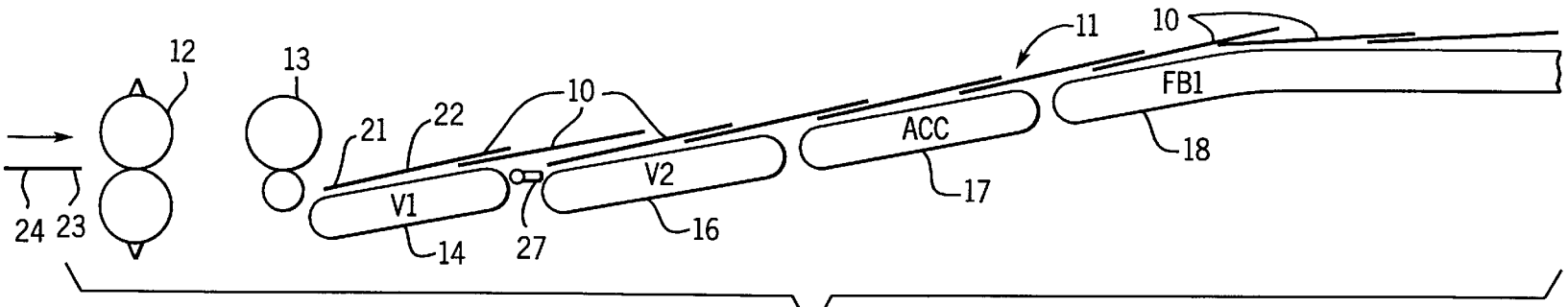
FIGS. 6–10 show sequenced views of another method for preventing edge butt.
Figure 7:
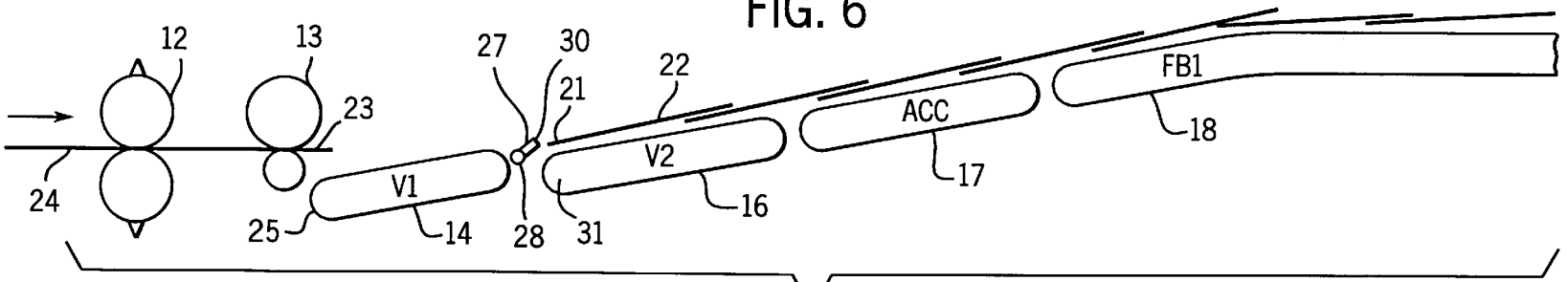

FIGS. 3–5 show, in schematic form, the operational sequence of a routine for preventing edge butt where a long new order sheet will overtake an old order of short sheets if normal discharge to the downstacker is continued. In accordance with this strategy, as soon as the tail end 21 of the last sheet 22 of the old order is captured on the upstream end 25 of the first vacuum shingling conveyor 14, all of the downstream conveyors are simultaneously accelerated to a substantially higher speed than the normal discharge speed of 250 fpm. Thus, as soon as the tail edge of the last sheet 22 drops onto the first vacuum shingling conveyor, the remaining downstream conveyors are accelerated to for example a speed in the range of 425 to 495 fpm. The result is that the tail end of the old order will not be overtaken by the first sheet 24 of the new order and edge butt will be prevented. After the first new sheet 24 of the new order leaves the exit nip control and falls on the stacker 11, the old order may be completed in the normal manner.

As seen in FIGS. 4 and 5, the long new order sheets enter the shingling section of the downstacker system in the normal manner, but the lead edge 23 of the first new sheet never overtakes the last sheet 22 of the old order. As soon as the tail end 26 of the first new sheet drops onto the first vacuum conveyor 14 the remaining stacker conveyors are slowed to the normal discharge speed of, for example, 250 fpm to complete the standard discharge cycle.

In the worst condition of combined high line speed (e.g. 1,000 fpm) and a small gap between orders (e.g. 0.2 second), the high speed routine to get the shingle out of the way of the incoming first sheet has been found to be inadequate to prevent edge butt. In this situation, an order separation routine requiring a different strategy and modified hardware is utilized. This routine is shown sequentially in FIGS. 6–10.

Figure 8:
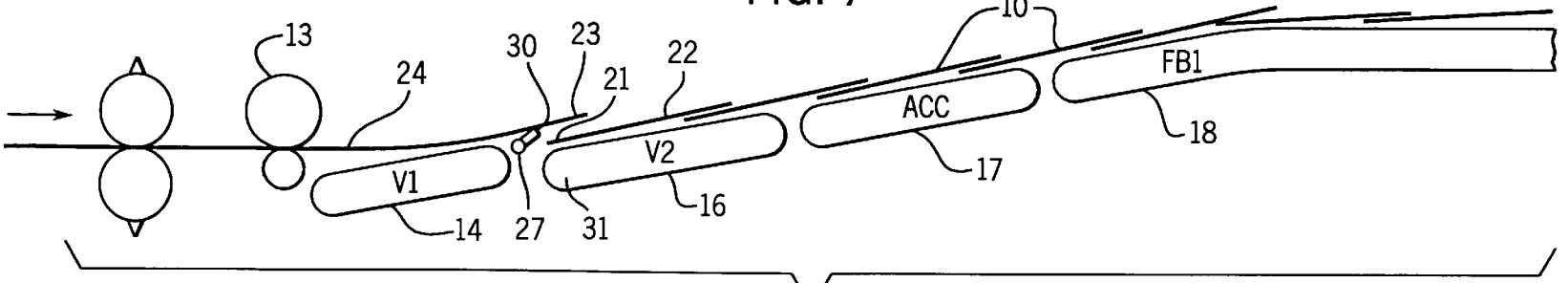
Figure 9:
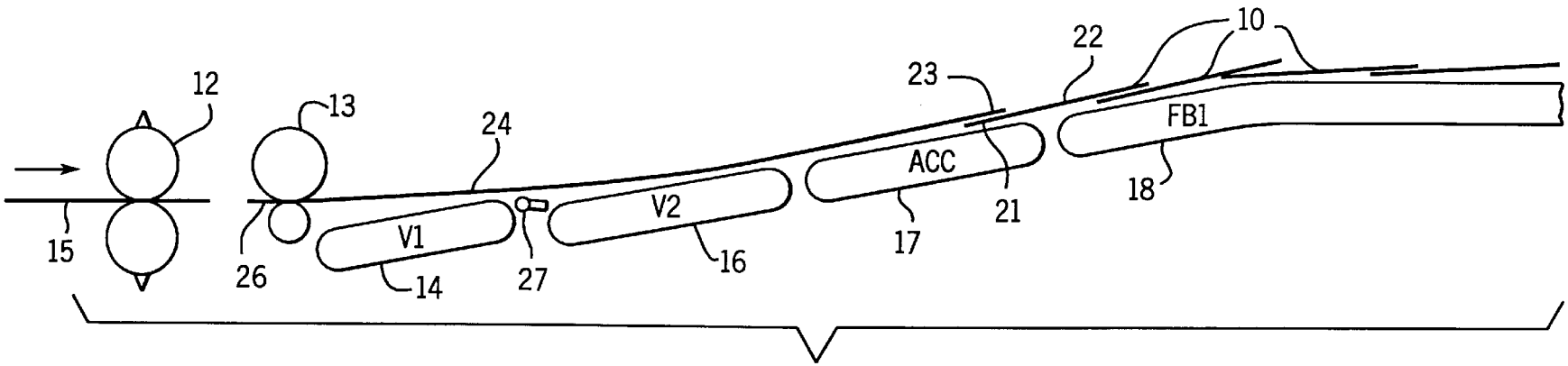
Figure 10:
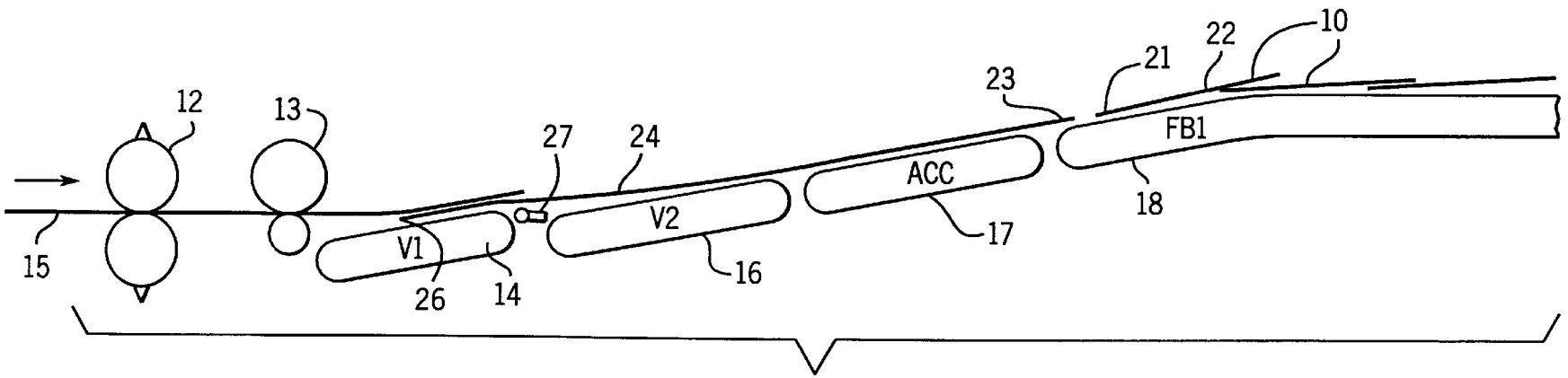

A pivotable pan 27 is positioned between the first and second vacuum conveyors 14 and 16. The pan 27 has an upstream pivot 28 allowing the pan to rotate between an inoperative position allowing free passage of the sheets thereover and an up position in which the downstream edge 30 of the pan extends upwardly into the path of the sheets. If the real time calculation by the system controller indicates that the routine shown in FIGS. 3–5 will not prevent edge butt, the routine of FIGS. 6–10 is automatically implemented. As will be seen, this routine is a modified version of the above described routine involving reestablishing the shingle. When the tail edge 21 of the last sheet 22 of the old order falls onto the first vacuum conveyor 14, the downstacker conveyor system moves initially to the high speed mode described with respect to FIGS. 3–5, namely, all of the conveyors downstream of the first vacuum shingling conveyor 14 accelerate to a speed approaching 500 fpm (again assuming a line speed of 1,000 fpm). As soon as the tail edge 21 of the last sheet passes the pan 27 and drops onto the upstream end 31 of the second vacuum conveyor (FIG. 7), all of the downstacker conveyors are stopped and the pan 27 is pivoted upwardly to its operative position in the path of the incoming first sheet 24 of the new order. As shown in FIG. 8, the lead edge 23 of the first sheet rides over the tail edge 21 of the old order last sheet (instead of butting into it) and the shingle is reestablished. Immediately, the second vacuum conveyor 16, accumulating conveyor 17 and flat belt conveyor 18 are accelerated to the high discharge speed (450–495 fpm in this example) until the incoming first new sheet 24 falls onto the first vacuum shingling conveyor 14 and comes under the control of the reduced speed thereof. As soon as the first sheet 24 is under control of the first vacuum shingling conveyor, the remaining downstream conveyors can be placed into a speed sequence following a normal discharge routine. Reestablishing the shingle on the second vacuum conveyor 16, rather than on the first vacuum shingling conveyor 14, prevents the long first new sheet from overriding a number of old order short sheets with the consequent problem described above of separating short sheets from under long sheets.

As indicated, the downstacker system control continuously calculates a gap between orders, the likely occurrence of edge butt, how much overrun of the first sheet of the new order is likely to occur, and automatically selects the routine which will prevent edge butt and minimize any overriding occurrence. Of course, if the gap is large enough such that edge butt will not occur, the order change is processed in a conventional manner and none of the special routines described hereinabove is implemented.

We claim:

1. In a stacker for paperboard sheets wherein sheets are individually fed at a fixed line speed onto a first shingling conveyor operating below line speed to form a shingle of sheets, and thereafter the shingle is conveyed over a plurality of downstream conveyors at a discharge speed to a stacking device where the shingle is formed into a vertical stack of sheets, a method for preventing edge butt at order change between the lead edge of the first sheet for a new order and the tail edge of the last sheet for an old order, said method comprising the steps of:

(1) utilizing the gap between the lead edge and the tail edge at an order change position when said tail edge is on the upstream end of the shingling conveyor, the difference between the line speed and the shingling conveyor speed, and the length of the new order sheet to determine if edge butt will occur;

(2) preventing the occurrence of edge butt by implementing a routine to adjust the speeds of the shingling conveyor and downstream conveyors, said routine selected from one of:

(a) shingling the first sheet of the new order on the old order; and, (b) with the first and last sheets in the order change position, accelerating the shingling conveyor and downstream conveyors together to a speed approaching line speed sufficient to prevent the gap from closing before the tail edge of said new order first sheet reaches the upstream end of the shingling conveyor; and, (3) thereafter returning the conveyors to discharge speed.

2. The invention as set forth in claim 1 wherein said conveyors are returned to discharge speed when the tail edge of the first sheet of the new order reaches the upstream end of said first shingling conveyor.

3. The invention as set forth in claim 1 wherein the sheets are fed by a driven nip positioned immediately upstream of the shingling conveyor, and the shingling conveyor comprises a variable speed vacuum conveyor with the upstream end positioned below the horizontal feed line of said nip, and wherein the shingling step farther comprises:

(1) stopping the shingling and downstream conveyors when the tail edge of said last sheet of the old order reaches the upstream end of said shingling conveyor;

(2) continuing to feed the new order first sheet until the lead edge there of overrides the tail edge of said last sheet; and, (3) restarting the shingling and downstream conveyors.

4. The invention as set forth in claim 1 wherein the first of said downstream conveyors comprises a second vacuum shingling conveyor, and wherein said shingling step further comprises:

(1) stopping the downstream conveyors when the tail edge of said last sheet of the old order reaches the upstream end of said second shingling conveyor;

(2) deflecting the lead edge of the first sheet of the new order vertically upward at the downstream end of said first shingling conveyor;

(3) continuing to feed the new order first sheet until the lead edge thereof overrides the tail edge of said last sheet; and, (4) restarting the downstream conveyors.

5. The invention of claim 4 wherein said deflecting step comprises:

(1) placing a pivotable pan in a gap between said first shingling conveyor and said second shingling conveyor;

(2) pivoting the pan upwardly from a normal running position simultaneously with said stopping step to place a downstream pan edge in the path of the lead edge of said first sheet of the new order to deflect the same upwardly; and, (3) pivoting the pan to the running position with the restarting step.

6. The invention of claim 5 wherein said restarting step comprises returning said shingling and downstream conveyors to a speed above discharge speed.

7. The invention of claim 6 wherein said restarting step comprises slowing said conveyors to discharge speed when the tail edge of the first sheet of the new order reaches the upstream end of said first shingling conveyor.

* * * * *